US006348013B1

(12) United States Patent
Kosmatka

(10) Patent No.: US 6,348,013 B1
(45) **Date of Patent: *Feb. 19, 2002**

(54) COMPLAINT FACE GOLF CLUB

(75) Inventor: John B. Kosmatka, Encinitas, CA (US)

(73) Assignee: Callaway Golf Company, Carlsbad, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/475,753

(22) Filed: Dec. 30, 1999

(51) Int. Cl.[7] ..... A63B 53/04
(52) U.S. Cl. ..... 473/329; 473/345
(58) Field of Search ..... 473/345, 346, 473/324, 329, 349

(56) References Cited

U.S. PATENT DOCUMENTS

| | | | | |
|---|---|---|---|---|
| 3,937,474 | A | | 2/1976 | Jepson et al. |
| 3,975,023 | A | | 8/1976 | Inamori |
| 3,989,248 | A | | 11/1976 | Campau |
| 4,252,262 | A | | 2/1981 | Igarashi |
| 4,326,716 | A | | 4/1982 | Lacoste |
| 4,398,965 | A | | 8/1983 | Campau |
| 4,498,672 | A | | 2/1985 | Bulla |
| 4,824,110 | A | | 4/1989 | Kobayashi |
| 5,261,663 | A | | 11/1993 | Anderson |
| 5,282,625 | A | | 2/1994 | Schmidt et al. |
| 5,299,807 | A | | 4/1994 | Hutin |
| 5,301,946 | A | | 4/1994 | Schmidt et al. |
| 5,310,185 | A | | 5/1994 | Viollaz et al. |
| 5,330,187 | A | | 7/1994 | Schmidt et al. |
| 5,344,150 | A | | 9/1994 | Schmidt et al. |
| 5,346,217 | A | * | 9/1994 | Tsuchiya |
| RE34,925 | E | * | 5/1995 | McKeighen |
| 5,417,419 | A | | 5/1995 | Anderson et al. |
| 5,429,365 | A | * | 7/1995 | McKeighen |
| 5,431,396 | A | | 7/1995 | Shieh |
| 5,437,456 | A | | 8/1995 | Schmidt et al. |
| 5,441,264 | A | | 8/1995 | Schmidt et al. |
| 5,458,334 | A | | 10/1995 | Sheldon et al. |
| 5,460,371 | A | | 10/1995 | Takeda |
| 5,472,203 | A | | 12/1995 | Schmidt et al. |
| 5,494,281 | A | | 2/1996 | Chen |
| 5,505,453 | A | | 4/1996 | Mack |
| 5,524,331 | A | | 6/1996 | Pond |
| 5,588,922 | A | | 12/1996 | Schmidt et al. |
| 5,669,827 | A | * | 9/1997 | Nagamoto ..... 473/345 |
| 5,703,294 | A | | 12/1997 | McConnell et al. |
| 5,743,813 | A | | 4/1998 | Chen et al. |
| 5,749,795 | A | | 5/1998 | Schmidt et al. |
| 5,755,627 | A | * | 5/1998 | Yamazaki ..... 473/345 |
| 5,762,567 | A | * | 6/1998 | Antonious ..... 473/345 |
| 5,788,584 | A | * | 8/1998 | Parente ..... 473/290 |
| 5,797,807 | A | | 8/1998 | Moore |
| 5,851,160 | A | * | 12/1998 | Rugge ..... 473/349 |
| 5,863,261 | A | | 1/1999 | Eggiman |
| D405,488 | S | * | 2/1999 | Burrows |
| 5,873,791 | A | | 2/1999 | Allen |
| 5,888,148 | A | | 3/1999 | Allen |
| 5,954,596 | A | * | 9/1999 | Noble ..... 473/346 |
| 6,152,833 | A | * | 11/2000 | Werner ..... 473/324 |

* cited by examiner

*Primary Examiner*—Stephen Blau
(74) *Attorney, Agent, or Firm*—Michael A. Catania

(57) ABSTRACT

A compliant golf club head permits a more efficient impact between a golf ball and the golf club head. By allowing a face section of the golf club head to flex rearwardly during impact with the golf ball internal stresses within the golf ball are reduced to yield a more efficient impact. A thin wall section is located generally parallel with the face and near the junction with a top, bottom heel and toe sections to allow the face of the golf club head to flex rearwardly.

1 Claim, 4 Drawing Sheets

COMPLAINT FACE GOLF CLUB

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a compliant face section of a golf club head to reduce energy losses when impacting a golf ball.

2. Description of the Related Art

Technical innovation in the material, construction and performance of golf clubs has resulted in a variety of new products. The advent of metals as a structural material has largely replaced natural wood for wood-type golf club heads, and is but one example of this technical innovation resulting in a major change in the golf industry. In conjunction with such major changes are smaller scale refinements to likewise achieve dramatic results in golf club performance. For example, the metals comprising the structural elements of a golf club head have distinct requirements according to location in the golf club head. A sole or bottom section of the golf club head should be capable of withstanding high frictional forces for contacting the ground. A crown or top section should be lightweight to maintain a low center of gravity. A front or face of the golf club head should exhibit high strength and durability to withstand repeated impact with a golf ball. While various metals and composites are known for use in the face, several problems arise from the use of homogeneous and non-homogeneous face structure.

A non-homogeneous face structure typically involves an insert centrally located which requires an exacting fit between two or more distinct elements, but has the advantage of utilizing beneficial material properties in a combination which is not available in each material individually. A homogeneous face structure is simpler to manufacture but is limited to the inherent material properties of one material. The present invention achieves the performance advantages of a non-homogeneous face structure with a simpler homogeneous construction.

BRIEF SUMMARY OF THE INVENTION

The present invention comprises an improved structure to reduce energy loss during impact of a golf club head with a golf ball. In a preferred embodiment the golf club head is a wood-type golf club head with a plurality of walls to define a hollow interior. During impact both the golf club head and the golf ball will compress, followed by the golf ball leaving the face of the golf club head where both the golf club head and the golf ball will experience a decaying vibration mode before returning to their respective original shapes. By allowing the golf club head to flex and "cradle" the golf ball during impact the internal stress in the golf ball is reduced, leading to a longer duration and more energy conserving impact. Extending the contact time of the golf ball with the face of the golf club reduces energy lost in the golf ball. By producing an channel or recess in one or more walls of the golf club head the contact time of the golf ball will increase as the linear distance the face travels during impact is increased. This channel defines a thin or minimum wall thickness in one or more sections of the golf club head. The face of the golf club head can be constructed from rigid material and still obtain the benefits of the present invention.

Shape and location of the recess determines important performance variables including durability, coefficient of restitution (COR) and angular deflection. Walls of the recess should be smoothly contoured to accommodate bending stresses from golf ball impact while allowing the face to move rearwardly in the golf club head without altering the face orientation.

Coefficient of restitution (COR) is well known to those of ordinary skill in the art, and is defined as the ratio of the of the golf ball velocity over the golf club head velocity, where velocity is measured before and just after impact of the golf ball with the golf club head.

Expressed mathematically, the equation is outlined below:

$$COR = \frac{V_{2\,ball} - V_{1\,ball}}{V_{1\,club\ head} - V_{2\,club\ head}}$$

where $V_{2\ ball}$ is the velocity of the golf ball measured immediately after impact with the golf club head; $V_{1\ ball}$ is the velocity of the golf ball measured immediately before impact with the golf club head; $V_{1\ club\ head}$ is the velocity of the golf club head measured immediately before impact with the golf ball; $V_{2\ club\ head}$ is the velocity of the golf club head measured immediately after impact with the golf club head.

One object of the present invention is to improve impact efficiency between a golf club head and the golf ball.

Another object is to allow a rigid material to perform as a compliant golf club face. Any number of rigid materials can be utilized in the manufacture of the golf club of the present invention to produce a compliant, or softer flexing performance during impact with the golf ball.

A further object of the present invention is a wood-type golf club head having an internal channel for flexing of the golf club face.

Another object of the present invention is a wood-type golf club head having an external channel for flexing of the golf club face.

Another object of the present invention is a golf club head comprising a face cup containing a channel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Like numbers are used throughout the detailed description to designate corresponding parts of a golf club head of the present invention.

Figure 1:
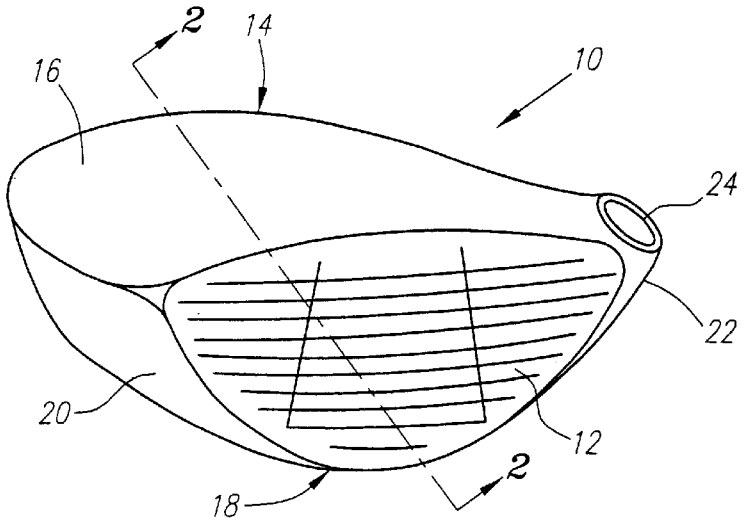
FIG. 1 is a perspective view of a golf club head of an embodiment of the present invention.

As shown in FIG. 1 a wood-type golf club head 10 comprises a face section 12, a rear section 14, a top section 16, a bottom section 18, a toe section 20, a heel section 22 and a hosel inlet 24 to accept a golf shaft (not shown). The golf club head 10 is a unitary structure which may be composed of two or more elements joined together to form the golf club head 10. Structural material for the golf club head 10 can be selected from metals and non-metals, with metals such as stainless steel and titanium being preferred embodiments. The face section 12 is an impact surface for contacting a golf ball 38 (not shown).

Figure 2:
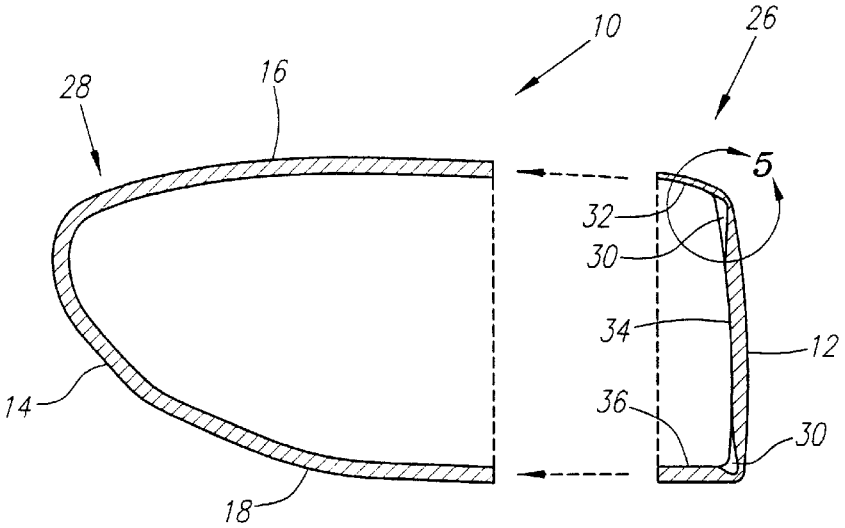
FIG. 2 is an exploded cross-sectional toe view along lines II—II of FIG. 1, illustrating a face cup with an annular channel and a body for attachment to the face cup of an embodiment of the present invention.

FIG. 2 is an embodiment of the present invention where the golf club head 10 is formed from the combination of a face cup 26 and a body cup 28, wherein the structural material for the face cup 26 and the body cup 28 may be the same or different. A channel or recess 30 is present on the interior of the face cup 26 in a ceiling surface 32, a wall surface 34 and a floor surface 36 to allow the face section 12 to act as a compliant surface. In other words, a relatively stiff material can behave as a more flexible material by employing the channels 30 of the present invention. The face section 12 is allowed to flex rearwardly toward the rear section 14 during impact with a golf ball. This action reduces the internal stress concentration within the golf ball, resulting in a more efficient momentum transfer from the golf club head 10 to the golf ball.

Figure 3:
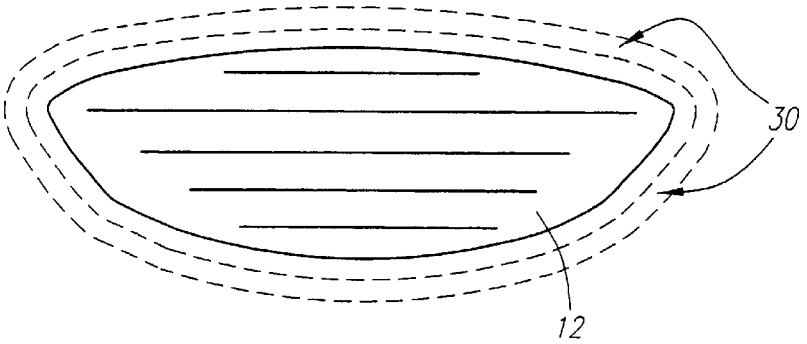
FIG. 3 is a front view of a face of an embodiment of the present invention with dashed lines representing the channel in the perimeter of the golf club head.

FIG. 3 is a front view of an embodiment of the present invention where the face section 12 of the golf club head 10 is shown in relation to the channel 30. Dotted lines indicate the channel 30 is located on the interior surface 32 and not visible from the exterior of the golf club head 10.

Figure 4A:
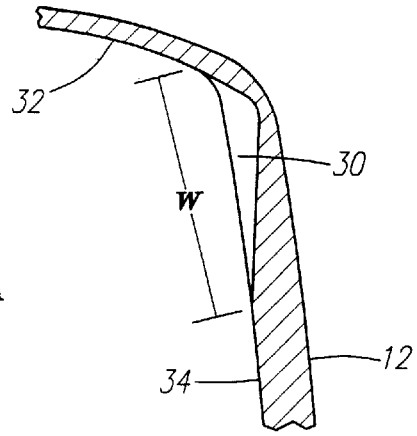
FIG. 4*a* is an enlarged view of section IV of FIG. 2 illustrating smooth contours for the channel of an embodiment of the golf club head of the present invention.
Figure 4B:
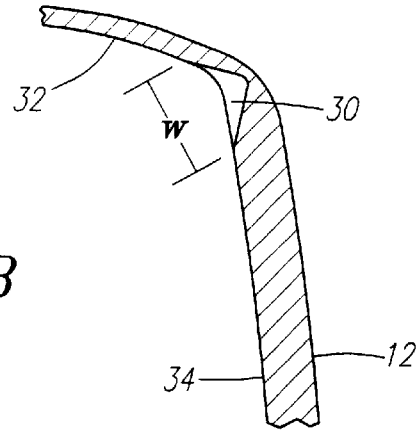
FIG. 4*b* is an enlarged view of section IV of FIG. 2 illustrating sharper contours for the channel than FIG. 4*a* of an embodiment of the golf club head of the present invention.
Figure 4C:
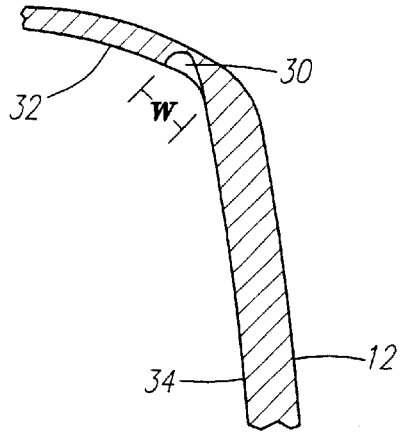
FIG. 4*c* is an enlarged view of section IV of FIG. 2 illustrating a small radius contour for the channel of an embodiment of a golf club of the present invention.

FIGS. 4*a–c* are enlarged views of section IV as shown in FIG. 2, and indicate various contours and locations for the channel 30. FIG. 4*a* illustrates the channel recess 30 located primarily toward the wall surface 34 and having a width w. FIG. 4*b* illustrates the channel 30 encompassing both the ceiling surface 32 and the wall surface 34, while having a narrowed width w than FIG. 4*a*. FIG. 4*c* illustrates the channel recess 30 located primarily toward the ceiling surface 32 and having a narrow width w.

Figure 5A:
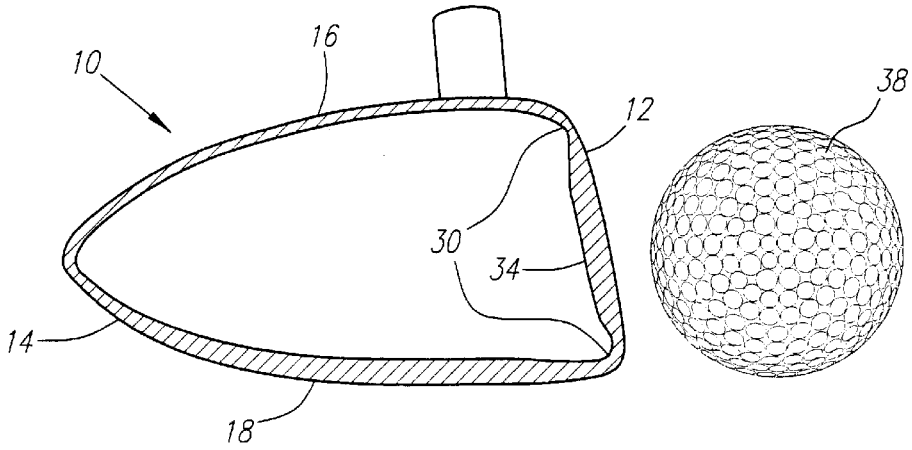
FIG. 5*a* is a cross-sectional toe view along lines II—II of FIG. 1, illustrating a golf club head of an embodiment of the present invention prior to impact with the golf ball.
Figure 5B:
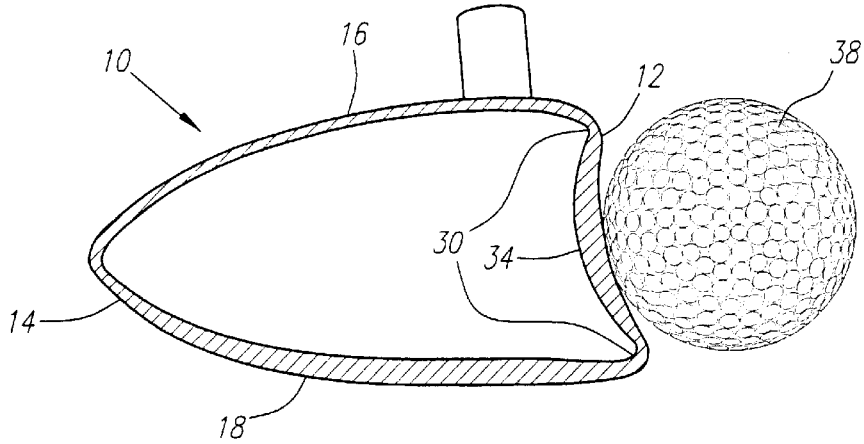
FIG. 5*b* represents the golf club head of an embodiment of the present invention during initial impact with the golf ball.
Figure 5C:
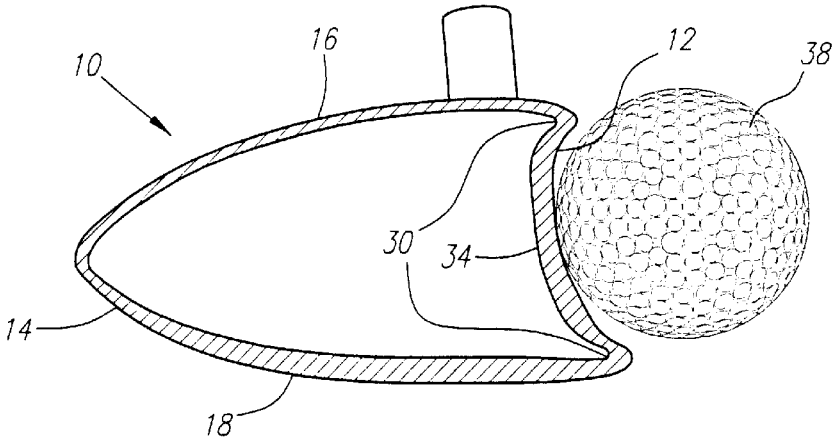
FIG. 5*c* represents the golf club of an embodiment of the present invention when fully deflected during impact with the golf ball.

FIGS. 5*a–c* depict an impact of the golf club 10 with the golf ball 38. In FIG. 5*a* the golf club head 10 appears prior to impact, with the channel 30 located at approximately the intersection of the face section 12 with the top section 16, the bottom section 18, the toe section 20 (not shown) and the heel section 22 (not shown). It is understood that the channel 30 can be located on or slightly rearward of the face section 12 and is not limited to the location illustrated in FIG. 5*a–c*. Initial contact of the golf ball 38 with the golf club 10 is shown in FIG. 5*b* where the face section 12 is shown as deflecting toward the rear section 14. Channel 30 acts as a hinge to facilitate the deflection of the face section 12. Maximum deflection of the face section 12 is shown in FIG. 5*c*, after which the face section 12 will return to original shape as depicted in FIG. 5*a* and the golf ball 38 will separate from the golf club head 10.

Figure 6:
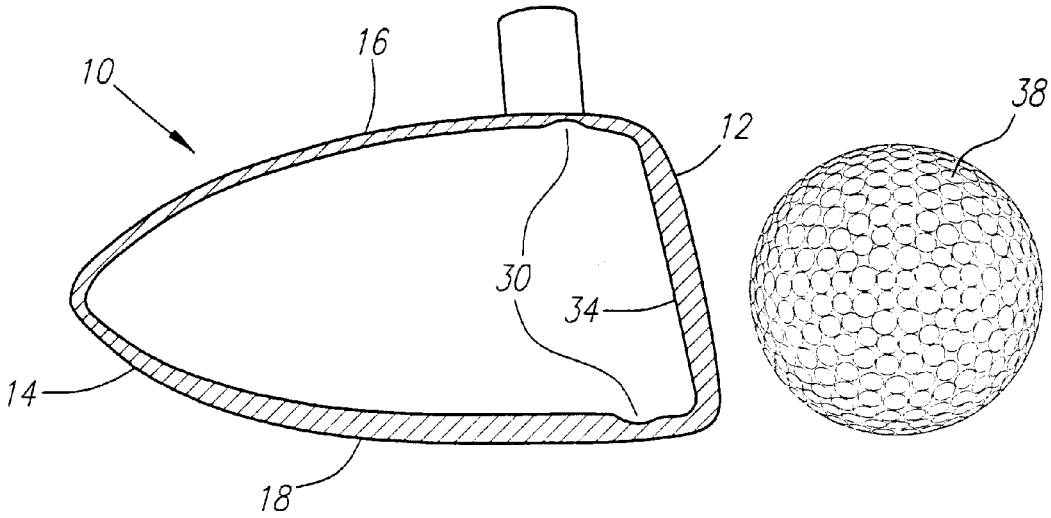
FIG. 6 is a toe view of an alternative embodiment of the present invention having the channel displaced toward the rear of the golf club head.
Figure 7:
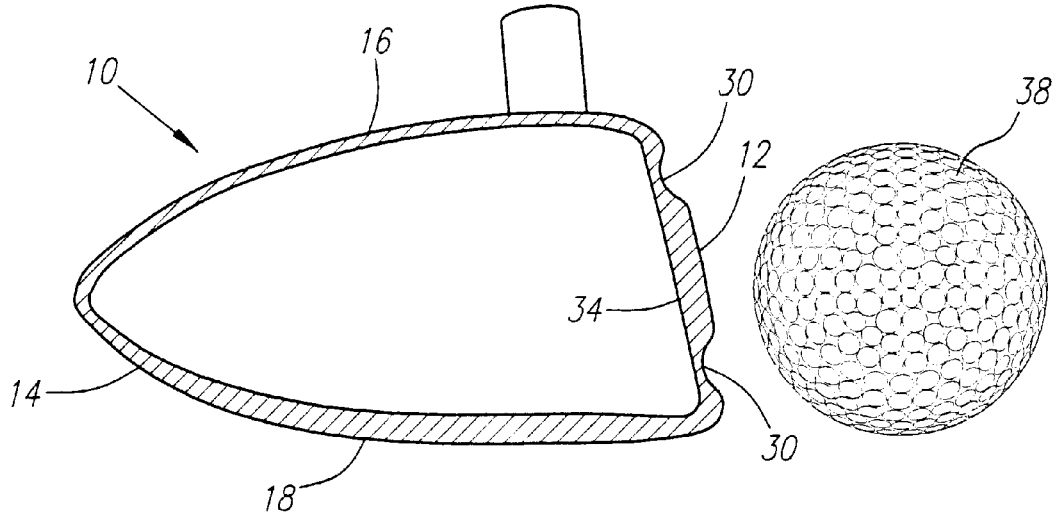
FIG. 7 is a toe view of another alternative embodiment of the present invention having the channel located on the exterior of the golf club head.

FIGS. 6 and 7 represent alternative embodiments of the present invention wherein the channel 30 may be located at various locations on or near the face section 12. The channel 30 can be located toward the rear section 14 as illustrated in FIG. 6, or on an exterior surface as illustrated in FIG. 7.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A metal wood-type golf club head comprising:

a face cup having a face section and a rear section extending laterally rearwardly from the face section, the rear section having an interior ceiling surface and floor surface, the face section being of relatively equal thickness in all directions, wherein the ceiling surface of the rear section has a first channel therein and the floor surface of the rear section has a second channel therein whereby the first channel and the second channel allow the face section greater flexibility upon impact with a golf ball wherein said first and second channels being a minimum wall thickness compared to a wall thickness of either side of said first and second channels; and a body cup having a top section, a bottom section, a toe section, and a heel section, the body cup joined to the rear section of the face cup.

* * * * *

UNITED STATES PATENT AND TRADEMARK OFFICE

CERTIFICATE OF CORRECTION

PATENT NO. : 6,348,013 B1
DATED : February 19, 2002
INVENTOR(S) : John B. Kosmatka It is certified that error appears in the above-identified patent and that said Letters Patent is hereby corrected as shown below:

Title page,
The title should read -- COMPLIANT FACE GOLF CLUB -- rather than a "COMPLAINT FACE GOLF CLUB".

Signed and Sealed this

Twenty-third Day of April, 2002

*Attest:*

*Attesting Officer*

JAMES E. ROGAN
*Director of the United States Patent and Trademark Office*